United States Patent [19]

Giuliani et al.

[11] Patent Number: 4,498,430

[45] Date of Patent: Feb. 12, 1985

[54] LINEAR RECIPROCATING PISTON ENGINE

[76] Inventors: Robert L. Giuliani, P.O. Box 30862, Honolulu, Hi. 96820; Karen A. Giuliani; Mark A. Giuliani, both of 45-310 Akimala Pl., Kaneohe, Hi. 96744

[21] Appl. No.: 551,179

[22] Filed: Nov. 14, 1983

[51] Int. Cl.[3] ..... F02B 75/32

[52] U.S. Cl. ..... 123/58 R; 123/197 AB

[58] Field of Search ..... 123/58 R, 57 R, 57 B, 123/54 R, 54 B, 54 A, 192 R, 192 B, 197 R, 197 AB, 197 AC, 197 C

[56] References Cited

U.S. PATENT DOCUMENTS

| | | | |
|---|---|---|---|
| 1,567,172 | 12/1925 | Powell | 123/197 R |
| 2,088,504 | 7/1937 | Brzezinski | 123/54 R |
| 2,482,136 | 9/1949 | Wright | 123/197 C |
| 2,757,547 | 8/1956 | Julin | 123/54 A |
| 2,914,137 | 10/1959 | Sykes | 123/192 B |

FOREIGN PATENT DOCUMENTS

| | | | |
|---|---|---|---|
| 1256904 | 2/1961 | France | 123/54 A |

*Primary Examiner*—Craig R. Feinberg
*Assistant Examiner*—David A. Okonsky

[57] ABSTRACT

This invention is an improvement over the arrangement and couplings between the piston rod and output power shaft in an internal combustion engine.

The piston rod's reciprocating movement is substantially linear along the center line of the rod and piston assisted by a guide slidably coupled to the rod. The rod has a set of gear teeth along its side forming a rack gear.

The output power shaft has at least one sector gear keyed or otherwise affixed thereto. The sector gear engages the gear teeth on the rod only during one direction of the rod's reciprocating movement which is the same direction as the power stroke. The sector gear is disengaged from the rod at the end of the piston's power stroke and remains disengaged, while continuing to rotate, until the beginning of the next stroke with the same direction as the power stroke. When the sector gear is disengaged, the piston and rod are returned to the beginning of the piston's power stroke by an oscillating sector gear which engages a second set of gear teeth on the rod. Timing gears synchronize the moving parts.

A plurality of sector gears, pistons and rods are shown in a second preferred embodiment which permits omitting separate timing gears and oscillating gears.

The invention is a cooler running engine which delivers higher torque than a comparable conventional engine while conserving fuel. A longer piston stroke is allowed which reduces pollution emissions.

18 Claims, 6 Drawing Figures

LINEAR RECIPROCATING PISTON ENGINE

FIELD OF THE INVENTION

This invention is in the field of converting the linear reciprocating motion of an engine piston and connecting rod to the rotary motion of the power output shaft.

BACKGROUND OF THE INVENTION

The inventor's date of conception of this invention precedes the invention's recording date in the U.S. Pat. Off. Document Disclosure Program on May 13, 1983 under document No. 117,323.

Internal combustion piston engines conventionally include a crank which is part of the engine's power output shaft. The reciprocating power piston is connected to the crank by a connecting rod so that the piston's linear reciprocating motion is converted to rotational motion of the power shaft. The coupling between the connecting rod and the crank is such that the moment arm is less than maximum when maximum force is applied by the piston. The force is applied to the piston by the expansion of the combusting air/fuel mixture. As the expansion increases, the moment arm increases and, simultaneously, the force from the expansion decreases. It is well known in the art that this conventional relationship of piston, connecting rod and crank effects less than the maximum available torque to the power shaft. Further, the changing angular relationship between the connecting rod and piston during the power stroke causes an undesired side thrust by the piston against the face of the cylinder wall. This results in a slapping sound which has been eliminated by offsetting the wrist pin center line from the piston center line. The offset solution is not the most satisfactory solution since it does nothing to increase the available torque to the power shaft. This conventional arrangement wastes power as heat.

Many earlier attempts have been made to increase mechanical efficiency of the piston engine by eliminating the angular and moment arm changes that the connecting rod undergoes in its relationship with the power output shaft and power piston. These attempts have serious drawbacks. Some do not increase the mechanical efficiency, i.e. U.S. Pat. No. 1,667,213 issued to Marchetti on Apr. 24, 1928. Others may increase the efficiency but sacrifice sturdiness or reliability as, for example, U.S. Pat. No. 4,363,299 issued Dec. 14, 1982 to Bristol.

REFERENCES CITED:

| U.S. PAT. DOCUMENTS | | | |
|---|---|---|---|
| 670,997 | 4/1901 | McLean | 123/197 R |
| 1,505,856 | 8/1924 | Briggs | 123/197 R |
| 1,667,213 | 4/1928 | Marchetti | 123/197 R |
| 2,757,547 | 8/1956 | Julin | 74/131 |
| 4,211,082 | 7/1980 | Bristol | 123/197 |
| 4,363,299 | 12/1982 | Bristol | 123/197 AB |

OTHER PUBLICATIONS

1. AUTOMATIVE ENGINES, 6th Ed. Crouse/Anglin, Chapt. 7.

SUMMARY OF THE INVENTION

This invention is an improvement of over earlier designs relating the piston, connecting rod and power shaft in an internal combustion engine resulting in increased mechanical efficiency. The output power shaft has a sectional gear which engages the connecting rod only during the downward stroke of the piston, particularly, the power stroke. The section gear is disengaged from the connecting rod during each an every upward stroke of the connecting rod and it is always re-engaged during the rod's downward power stroke.

An oscillating rocker arm, operated by an eccentric pin on a timing gear, is shown gear meshed to the connecting rod at all times to raise the piston on its upward stroke and follow the rod on the downward stroke.

The combination of parts and kinematics provides a moment arm of constant maximum length. The entire force from the power piston is applied perpendicularly to the moment arm. Less power is needed from the piston while allowing a longer piston stroke resulting in fuel savings and more complete combustion to reduce pollutant emissions.

A second preferred embodiment of the invention, disclosed herein, shows how the invention may be constructed to modularize an engine. This embodiment is particularly adaptable to single cylinder engines or as a power unit in the inventor's MODULARIZED ENGINE invention.

It is an object of the invention to increase mechanical advantage over earlier designs.

Another object is to reduce fuel consumption relative to conventional engines of comparable power.

Another object is to increase thermal efficiency resulting in a cooler running engine.

A longer than conventional piston stroke is attainable which permits more complete fuel burning and less pollution emittants.

Another object is to greatly increase power by increasing torque through a piston that offers minimum resistance to the expanding combustion elements because the invention directs the entire force of the combustion perpendicularly to a fixed length moment arm of the output power shaft.

Other objects and advantages of the invention will become evident from further perusal of this disclosure.

DESCRIPTION OF THE PREFERRED EMBODIMENTS

It will become obvious that this invention can use conventional methods for lubrication and electrical systems; push rods or timing chains and their related camshafts for valve operation; and the like. These obvious relationships with conventional engine working parts and systems are omitted in the disclosure to better concentrate on clarifying the novel aspects of the invention.

Certain terms are used herein such as: "clockwise", "lower", "bottom", "topmost", etc. to signify essential relationships of parts and movements as depicted in the related drawings.

Figure 1:
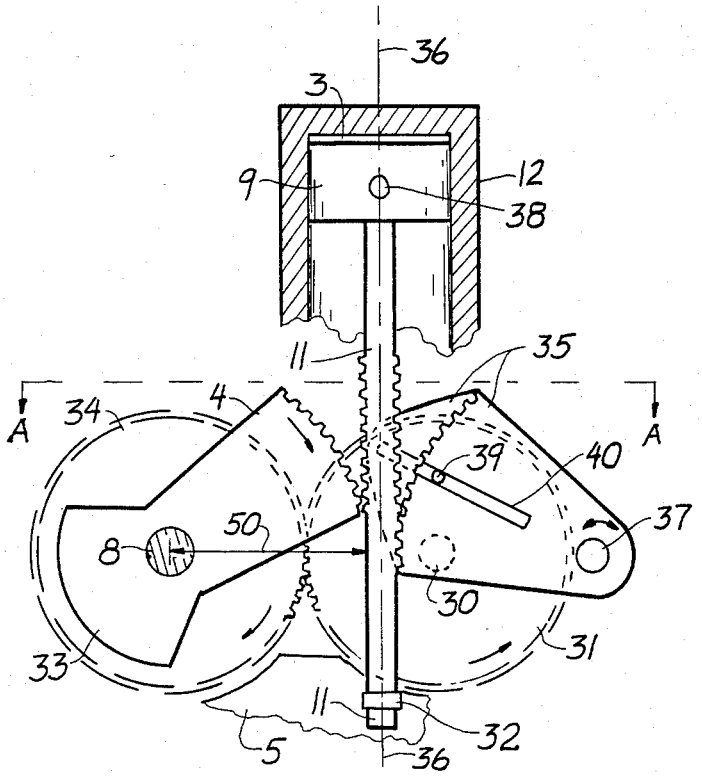
FIG. 1 is a side elevational showing relationships between members of one preferred embodiment of the invention that is particularly adaptable to single cylinder engines or as a power unit in the inventor's MODULARIZED ENGINE invention.
Figure 3:
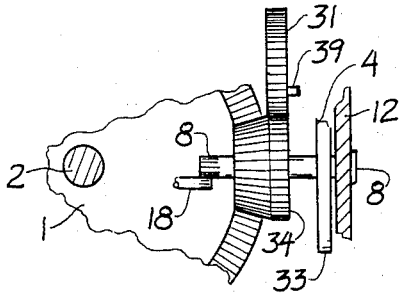
FIG. 3 is a top view showing the essential engagement of moving parts between the embodiment of FIG. 1 and the inventor's MODULARIZED ENGINE invention.
Figure 2:
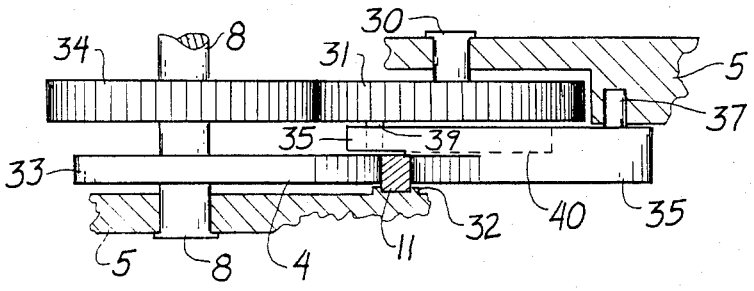
FIG. 2 is a top view taken substantially along line A—A of FIG. 1.

A preferred embodiment is shown in FIG. 1, FIG. 2 and FIG. 3 which is particularly useful for single cylinder engines or as adaptations to engines designed for replaceable, self-contained power units as in the previously mentioned MODULARIZED ENGINE.

In FIG. 1, the compression chamber 3 and conventional reciprocating piston 9 are shown in the cylinder housing 12. A fragmented part of the engine housing 5 is shown. Piston 9 is shown in its topmost position at the beginning of the power stroke. A piston rod 11 is connected to the piston 9 and the rod's lower end is slidable in a guide 32 which is fixed to-or part of-engine housing 5. The conventional wrist pin 38 for coupling rod 11 to piston 9 may be omitted in favor of a single casting of the piston 9 and connecting rod 11.

Rod 11 has gear teeth on its sides. A sector gear 4 is fixed to output shaft 8. Shaft 8 is suitably journaled in engine housing 5 as depicted in FIG. 2. Sector gear 4 rotates in one direction, shown clockwise in FIG. 1. The sector gear 4 has a counterweight 33. The maximum extension of counterweight 33 from the rotational axis of shaft 8 is less than the radial distance 50 to the gear teeth. Weight 33 does not interfere with the movement of the rod 11 at any time. The length of the geared arc or sector gear 4 should be slightly less than the length of the stroke of piston 9. The gear 4 will engage the gear teeth on rod 11 only during the downward stroke of piston 9. The sector gear 4 will always be disengaged from rod 11 during the reverse, or upward, stroke of piston 9.

Timing gear 34 is fixed to power shaft 8 and is shown in FIG. 1 and FIG. 2 to be spur meshed with timing gear 31. Gear 31 is fixed to stub shaft 30 shown journaled, in FIG. 2, in a fragmented part of housing 5.

Timing gear 31 has an eccentric pin 39 which engages a slot in a rocker 35. Rocker 35 is fixed to stub shaft 37 which is journaled in housing 5 as depicted in FIG. 2. Notice from FIG. 2 that rocker 35 may be extended between gear 31 on one side and rod 11 and gear 4 on the other side. This permits the piston 9 to be closer to shaft 8 allowing the diameter ratio between gears 31 and 34 to be easily established so that proper synchronization is effected between gear 4, rod 11 and rocker 35.

Rocker 35, as shown in FIGS. 1, 2, is really a form of oscillating gear having gear teeth along its peripheral arc which engage the second set of gear teeth on piston rod 11. The length of the peripheral arc of rocker 35 is longer than the length of the stroke of piston 9 so that, unlike sector gear 4, the rocker 35 and rod 11 remain constantly engaged during all movement of the invention's parts.

FIG. 3 shows how a gear fixed to the output power shaft 8 may engage the reduction gear 1. A plurality of the embodiment shown in FIG. 1 and FIG. 2 may be circumferentially dispersed about the gear 1. In this case, output power shaft 2 is the engine's output power shaft. Cylinder housing 12 rotatably supports the embodiment's power shaft 8. Camshaft 18, shown gear meshed to shaft 8, reciprocates push rods that operate valves which is more fully explained in the previously mentioned MODULARIZED ENGINE disclosure.

Figure 4:
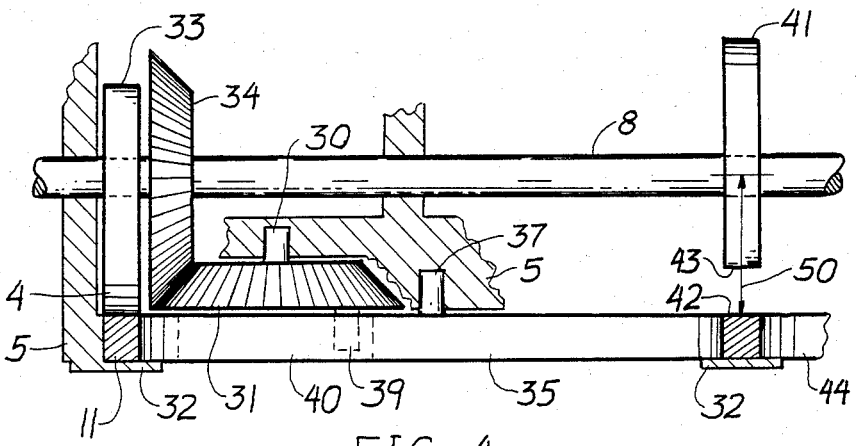
FIG. 4 is a top view of a second embodiment of the invention with parts fragmented.
Figure 5:
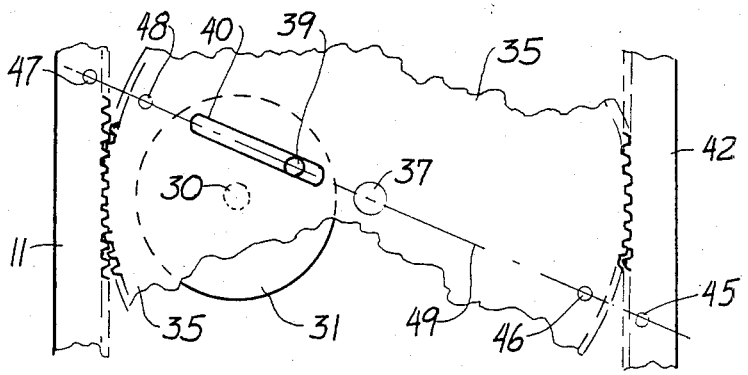
FIG. 5 shows a fragmented part of a type of lever, or rocker, in combination with a timing gear, used to synchronize movement between two piston rods.

FIG. 4 and FIG. 5 show a second preferred embodiment of the invention where a plurality of piston rods 11 and 42 are synchronized with the engine's output power shaft 8.

In FIG. 4, the timing gears 31 and 34 are shown bevel meshed. Gear 34 is fixed to shaft 8 and gear 31 is fixed to stub shaft 30 journaled in housing 5 as previously explained for the preferred embodiment shown in FIG. 1. In this embodiment, however, rocker 35 gear meshes with rod 11 on its left side and rod 42 on its right side. Shaft 37 of rocker 35 is placed so that it does not interfere with the action between eccentric pin 39 and slot 40 as shown in the fragmented illustration in FIG. 5. It can be readily seen that there is a cam action between the parts which synchronizes rotation of timing gear 31 with raising one of the rods 11 or 42 while simultaneously lowering the other.

Notice in FIG. 4 how sector gears 4 and 41 are arranged with the counterweights 33 and 43 so that when one of the sector gears is engaged with a piston rod (sector gear 4 with rod 11 in FIG. 4) the weight is spaced apart from the other rod (weight 43 apart from rod 42 in FIG. 4) leaving rod 42 free to move upward while rod 11 is simultaneously moving downward engaged with sector gear 4.

FIG. 5 depicts timing marks 45 and 46 relating rocker 35 to rod 42 an timing marks 47 and 48 which relate rocker 35 to rod 11. A timing mark center line 49 will oscillate about the axis of shaft 37 during movement of the parts.

Figure 6:
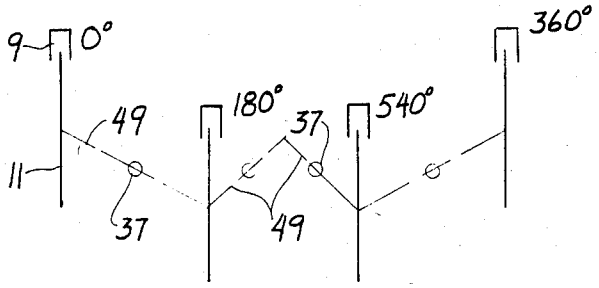
FIG. 6 shows the kinematic relationship between rockers and four synchronized piston rods to give a conventional firing order for a four cylinder engine.
Figure 1:
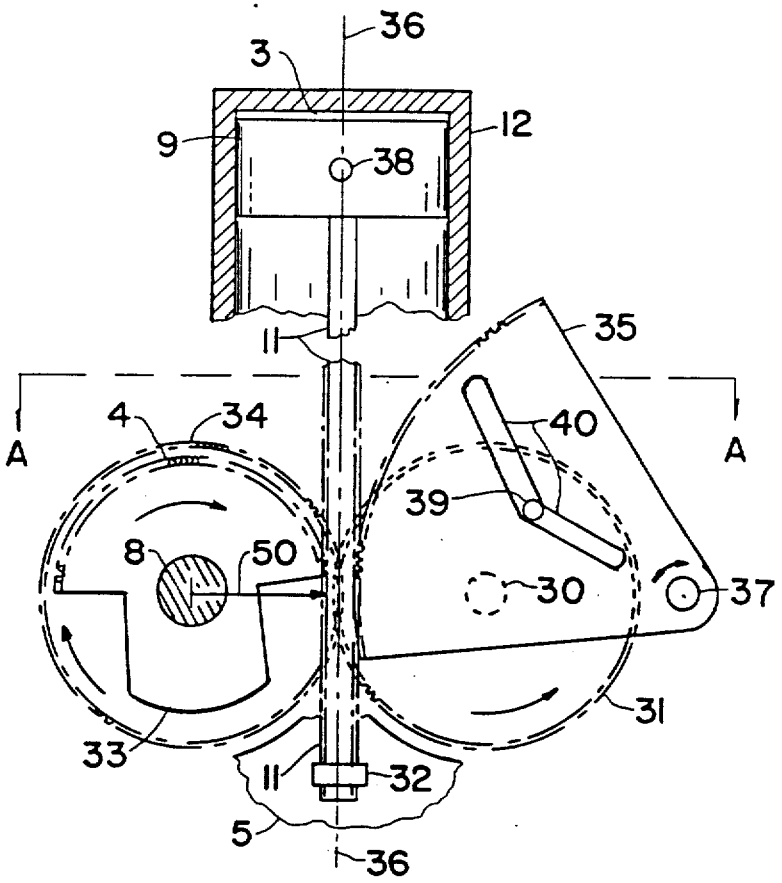
Figure 2:
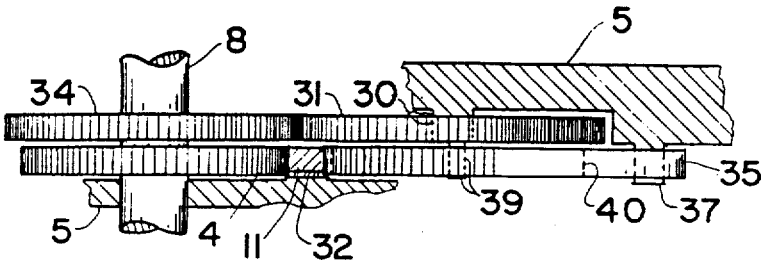

FIG. 6 depicts the synchronized kinematics of the piston rods 11,42, etc., through the timing mark center line 49 in a four cycle, four cylinder engine to effect a conventional firing order. The simultaneous relative displacement between each of the pistons is shown in degrees, i.e. 0°, 180°, 360°, 540°, to enable the reader to compare the novel movements of the parts to those in a complete four cycle (two crankshaft revolutions) conventional engine. These piston displacements also can be compared to the angular displacement of shaft 8 for a four cycle movement of the pistons 9, etc.

The timing gears 31,34 can be omitted in engines using this invention where there are enough cylinders so that the power impulses of the pistons overlap each other. While the rockers 35 synchronously link all the pistons through the piston rods, the overlapping engagement between sector gears and rods will synchronize the power shaft 8 with each and all the pistons. The conventional flywheel may be attached to shaft 8 serving the same purpose as in a conventional engine.

OPERATION

FIG. 1 depicts the relative positions of the invention's parts at the topmost position of piston 9 in cylinder 12. These positions between rod 11, sector gear 4 and rocker 35 at the beginning of the piston's power stroke will be the same for all the preferred embodiments.

During startup, the rotating timing gear 34, which is attached to shaft 8, will drive timing gear 31 through their gear mesh. Piston 9 will be caused to reciprocate in cylinder 12 through the cam action of eccentric pin 39 engagement with slot 40 of rocker 35. Angular momentum from weight 33 and a conventional flywheel will maintain rotation of shaft 8 until the air/fuel mixture in chamber 3 is combusted. Combustion in chamber 3 will power piston 9 and rod 11 downward. The guide 32 will limit movement of rod 11 to displacement along the center line 36. The powered rod 11 is the driving gear for rocker 35 on the downward stroke. Eccentric pin 39 follows rocker 35 while sliding to the left in slot 40 on its downward path around shaft 30. This causes timing gear 31 to rotate counter clockwise. The mesh between timing gear 31 and timing gear 34 brings sector gear 4 into contact with the geared rod 11 as the rod begins its downward stroke substantially as shown in FIG. 1.

Gear 4 may be engineered to come into mesh with rod 11 at the topmost position of the power stroke of piston 9 or shortly thereafter so that all the power from the piston is transmitted to power shaft 8 directly through sector gear 4. Any load on rocker 35 should be limited to inertia of piston 9, friction between rings and cylinder walls, and compression of the air/fuel mixture. It should be obvious that automatic spark advance is readily accomplished in substantially the conventional manner. Angular momentum in weight 33 and a flywheel attached to shaft 8 permits spark advance without stalling the apparatus.

Shortly before the bottom of the downward stroke of piston 9, sector gear 4 will disengage from rod 11. Rocker 35 will remain engaged at all times with rod 11 since the length of its geared arc is greater than the stroke of piston 9. Angular momentum will continue to rotate shaft 8. The timing gear 34, fixed to shaft 8, will rotate timing gear 31. The eccentric pin 39 will have revolved to its bottom most position during the downward stroke of piston 9. As gear 31 continues to rotate, pin 39 will revolve upward, counter clockwise, while simultaneously sliding to the right and back to center in its slot 40. This upward path taken by pin 39 will cause a cam action. The geared periphery of rocker 35 will oscillate upward which, in turn, forces rod 11 up along center line 36. Rod 11 will remain engaged at all times because of guide 32.

When pin 39 again reaches its topmost position over the axis of shaft 30, piston 9 will be at its topmost position. At this point, sector gear 4 will again be positioned to reengage rod 11, as shown in FIG. 1, for the downward stroke of piston 9 to repeat the cycle. If desired, sector gear 4 can be made to engage rod 11 only during the power stroke of a four cycle engine by engineering gear 34 with twice the diameter of gear 31.

In some designs, there may be interposed an idler gear, journaled to housing 5, and meshing with gear 34 and gear 31, which would rotate gear 31 in the same direction as gear 34. As shown in FIG. 1, gear 31 would then rotate clockwise and the leverage created would act to inherently reduce the load on pin 39 for raising piston 9 which would come from the maximum possible distances between shaft 37 and pin 39.

FIG. 2 shows where clearances exist between the moving parts shown in FIG. 1. The interfacing of the moving parts, shown in FIG. 2, effect their proper synchronous working.

FIG. 3 shows the timing gear 34 extended as a bevel gear to engage reduction gear 1. This configuration of the preferred embodiment shown in FIG. 1, 2 is adaptable to the inventor's MODULARIZED ENGINE invention as a power unit. In this case, the shaft 8 acts for a unit to transmit power through the reduction gear 1 to power shaft 2. The reduction gear 1 is fixed to the engine's output power shaft 2. A plurality of power units, comprised of the preferred embodiment, are forseen disposed along the periphery of gear 1 in the manner shown in FIG. 3.

A second preferred embodiment of the invention is depicted in FIG. 4 and FIG. 5. The timing gears 31,34 are in bevel engagement to permit placement of a plurality of piston rods, depicted by rod 11 and rod 42, along a line substantially parallel to shaft 8. The rocker 35 engages rod 11 and rod 42 simultaneously in two rack and pinion gear arrangements. FIG. 5 shows shaft 37 placed along a vertical line midway between rod 11 and rod 42 so that vertical movements of the rods 11,42 are equal, opposite and synchronized under contol or rocker 35. The timing mark 49 will oscillate about the axis of shaft 37 during operation.

Notice in FIG. 4 that the radial distance 50 of the sector gears 4,41 is longer than the radial distance of the respective weights 33,43 so that the weights will not interfere with the movement of the rods at any time. Comparison with the distance 50 in FIG. 1 will make this point obvious. A second rocker 44, shown fragmented in FIG. 4, may function to reciprocate a third piston rod without being interfaced with timing gears 31,34. This arrangement can be better visualized by considering FIG. 6 for a 4 cylinder engine.

The invention's kinematics in a four cylinder, four cycle engine having a conventional firing order is depicted in FIG. 6. The center lines 49 depict the positions and alignments of the rockers relative to their respective rods when the pistons 9 are situated as shown. The pistons 9 are shown relative to the angular displacement of shaft 8. Notice that there are two centerlines 49 between the piston shown at 180° and the piston shown at 540°. This indicates two rockers 35 (or gears) of equal diameter. They would engage each other in spur and each would engage one of the rods in a rack and pinion so that the second piston (180°) and third piston (540°) move simultaneously in the same direction as happens in conventional engines having the same firing order.

In a design of this embodiment having a plurality of pistons with overlapping power pulses, the two timing gears 31,34 may be omitted. In such an arrangement, the engagement of sector gears and their respective rods on all downward strokes insures that at least one of the sector gears is always engaged with its rod at all times to effect synchronization of the shaft 8 with the power pistons. The rockers will be in constant engagement with their respective rods which will synchronize movement of all the rods with the rod that is engaged with its sector gear. In this manner, all the moving parts will be synchronous during operation of the engine without timing gears 31,34.

It is to be understood that the forms of the invention herewith shown and described are not to be taken as the only preferred embodiments of the invention. Various changes may be made in the shape, size and arrangement of the parts. Equivalent elelments may be substituted for those illustrated and described herein. Parts may be reversed and certain features of the invention may be utilized independently of the other features, all without departing from the intent and scope of the invention as defined in the accompanying claims. Examples of changes that may be made to the forms described without departing from the intent or scope of the invention include, but are not limited to, the following:

1. Shaft 8 can be designed with cam lobes for effecting cylinder valve operation through push rods and rocker arms.

2. Timing gears 31,34 may be deleted in certain designs having overlapping piston power pulses.
3. Certain parts, such as rockers 35 and timing gears 31,34 may be made of plastic for weight savings.
4. Rocker 35 may be a full gear.
5. Guide 32 may be omitted by rigidly coupling, or single casting, the piston 9 and rod 11.
6. An idler gear may be placed between timing gears 31,34 and rotatably supported by housing 5 to reverse the rotation of gear 31 from that shown in the drawings.
7. Guide 32 may be affixed to cylinder housing 12 to permit removel of the cylinder and working parts as a unit in a manner more fully described in the previously mentioned MODULARIZED ENGINE invention.

Having described my invention, I claim:

1. An apparatus for converting motion between linear and rotary, the combination comprising:

a housing;

at least one crankless power shaft rotatably supported by the housing;

a plurality of members having linear reciprocating motion;

a plurality of rods movable along a linear path, each of the rods in the plurality communicating with a member at the one end for effecting linear reciprocating motion therebetween;

the plurality of rods disposed essentially parallel adjacent the shaft, aligned essentially perpendicular thereto;

a plurality of crankless first elements non-rotatably secured to the power shaft along the length thereof, each first element angularly displaced from at least one of the other first elements in the plurality;

each of the first elements adapted to communicate with a rod during a first direction of the linear reciprocating motion;

each of the first elements displaced from communicating with a rod during the second direction of the linear reciprocating motion; and at least one component rotatably supported by the housing, the component communicating with more than one of the rods wherein linear motion of each rod in the plurality in the first direction effects continuous rotary motion of the power shaft through communication with the angularly displaced first elements and, simultaneously, each of the other rods in the plurality being displaced along the linear path by the component through the communication therebetween to bring about conversion between the linear motion of the member and the rotary motion of the power shaft.

2. The combination of claim 1 wherein the apparatus includes: the housing having a plurality of cylinders therein:

the members comprised of a power piston reciprocal in each of the cylinders;

the rod including rack gears;

the first element including a sector gear;

the communication between the rod and the first element including a gear mesh;

the angular displacement effecting synchronization between the power shaft and the plurality of rods;

the component including at least one oscillating intermittent gear for effecting synchronous reciprocal movement between at least two of the rods in the plurality;

the communication between the component and the rod including a gear mesh, the communication further effecting synchronization of movement between all the rods in the plurality whereby synchronization between the continuous rotary motion and the linear movement of each of the rods in the plurality is brought about.

3. An apparatus for converting motion between linear and rotary, the combination comprising:

a housing;

at least one crankless power shaft rotatably supported by the housing;

at least one member having linear reciprocating motion;

at least one rod movable along a linear path, the rod communicating with the member at the one end for effecting linear reciprocating motion therebetween;

at least one crankless first element non-rotatably secured to the power shaft, the first element adapted for direct communication with the rod for effecting continuous rotary motion in the power shaft;

the direct communication occurring during a part of the linear reciprocating motion in one direction;

at least one second element non-rotatably secured to the power shaft;

at least one fourth element rotatably supported by the housing;

the fourth element adapted to communicate directly with the rod during movement in a direction opposite the one direction of the linear reciprocating motion; and at least one third element communicating with the second and fourth elements for transmitting motion therebetween wherein the said communications convert motion between linear of the member and continuous rotary of the power shaft.

4. The combination of claim 3 wherein said communications effect synchronization of the rotary movement of the shaft with the linear reciprocating motion of the member.

5. The combination of claim 3 wherein said communications include gear meshes.

6. The combination of claim 3 wherein the power shaft includes a solid cylinder, the second element includes a circular cross sectional of the solid cylinder and the first element includes a cross sectional shaped to engage the rod in only one direction.

7. The combination of claim 3 wherein the fourth element includes levers.

8. The combination of claim 7 wherein the levers are comprised of radially opposing sector gears.

9. The combination of claim 3 wherein the communication between the second and third elements includes a fifth element for effecting unidirectional motion between the second and third elements.

10. The combination of claim 9 wherein the fifth element includes an idler gear, the second and third elements include timing gears and the communication therebetween includes gear meshes.

11. The combination of claim 3 wherein the apparatus includes:

an internal combustion engine having at least one cylinder;

the member comprised of a piston reciprocal within the cylinder;

the first element having substantially the shape of a partial disc;

the second element having essentially the shape of a disc;

the third element having essentially the shape of a disc;

the second element having rotary engagement with the third element;

the fourth element in juxtaposition to the third element;

the third element operatively engaging the fourth element through an elongated aperture on said fourth element and an eccentric part on said third element to convert rotary movement of the third element to oscillating motion of the fourth element; and the fourth element operatively engaging the rod so that conversion between linear reciprocating motion and oscillating motion occurs therebetween wherein the linear motion of the piston in the one direction is converted to continuous rotary motion of the shaft and the continuous rotary motion is converted to the linear motion in the opposite direction.

12. The combination of claim 11 wherein:

said second element includes a timing gear;

said third element includes a timing gear; and the communication therebetween includes a spur gear mesh.

13. The combination of claim 11 wherein the first element includes an intermittent gear which comprises a sector gear.

14. The apparatus of claim 3 wherein the combination includes:

an internal combustion engine having a plurality of cylinders;

a plurality of members, each member comprised of a piston having linear reciprocating motion within a cylinder;

a plurality of rods, each rod communicating with at least one of the pistons;

the plurality of rods disposed essentially parallel adjacent the shaft, aligned essentially perpendicular thereto;

a plurality of said first elements non-rotatably secured to the shaft along the length thereof;

each of the plurality of rods communicating with a first element during a first direction of the linear reciprocating motion, each first element displaced from communicating with the rod during the second direction of the linear reciprocating motion;

at least one component rotatably supported by the engine; and the component communicating with at least one of the rods to effect linear reciprocating motion between the plurality of rods whereby the communication of at least one of the first elements with at least one of the rods effects rotary movement of the shaft according to the linear reciprocating motion of said plurality of members.

15. The combination of claim 14 wherein:

the first element includes sector gears, the gears angularly displaced about the axis of the shaft;

the rod includes rack gears;

the communication between the rod and the first element includes a gear engagement; and the angular displacement effects said engagement between at least one rod and first element during said first direction while simultaneously the other of the plurality of rods are disengaged from the other of the plurality of elements by the angular displacement.

16. The combination of claim 14 wherein the engine includes:

a combustion chamber within each cylinder for combusting fuel therein;

the combustion imparting power to effect linear motion in said first direction;

the power having pulses, the pulses repetitive during spaced intervals of time according to the linear reciprocating motion; and said angular displacement effecting said engagement according to said intervals so that the rotary movement is synchronized with the motion of the plurality of members in the first direction.

17. The combination of claim 14 wherein the shaft includes:

at least one second element;

at least one third element rotatably engaging the second element;

the third element in juxtaposition with said component;

an eccentric part upon the third element;

an elongated aperture upon the component; and the eccentric part operatively engaging the aperture so that oscillating motion of the component occurs according to rotary motion of the third element whereby the rotary movement of the shaft becomes synchronized with the linear reciprocating motion of said plurality of members.

18. The combination of claim 17 wherein:

the second element includes a timing gear; and the third element includes a timing gear in bevel mesh with the second element.

* * * * *

UNITED STATES PATENT AND TRADEMARK OFFICE

CERTIFICATE OF CORRECTION

PATENT NO. : 4,498,430

DATED : February 12, 1985

INVENTOR(S) : Robert L. Giuliani et al

It is certified that error appears in the above-identified patent and that said Letters Patent is hereby corrected as shown below:

Figures 1 and 2 should appear as shown on the attached sheet.

Signed and Sealed this

Fifth Day of December, 1989

*Attest:*

JEFFREY M. SAMUELS

*Attesting Officer*

*Acting Commissioner of Patents and Trademarks*